US008823621B2

(12) United States Patent
Chu et al.

(10) Patent No.: US 8,823,621 B2
(45) Date of Patent: Sep. 2, 2014

(54) BUFFER AND DISPLAY SYSTEM UTILIZING THE SAME

(75) Inventors: Ting-Yao Chu, Fengshan (TW); Jiun-Wei Lu, Yonghe (TW); Sheng-Feng Huang, Miaoli (TW)

(73) Assignee: Innolux Corporation, Miao-Li County (TW)

( * ) Notice: Subject to any disclaimer, the term of this patent is extended or adjusted under 35 U.S.C. 154(b) by 539 days.

(21) Appl. No.: 13/182,318

(22) Filed: Jul. 13, 2011

(65) Prior Publication Data

US 2012/0050244 A1 Mar. 1, 2012

(30) Foreign Application Priority Data

Aug. 27, 2010 (TW) ..... 99128790 A

(51) Int. Cl.
*G09G 3/36* (2006.01)

(52) U.S. Cl.
CPC ..... *G09G 3/3677* (2013.01); *G09G 2320/0223* (2013.01); *G09G 2310/067* (2013.01); *G09G 2310/0291* (2013.01)
USPC ..... 345/94; 345/211; 345/98

(58) Field of Classification Search
CPC ..... G09G 3/3677; G09G 3/3674; G09G 2310/0291; G09G 2310/066; G09G 3/2922
USPC ..... 345/60–63, 204, 211, 212, 94, 98, 208; 327/170
See application file for complete search history.

(56) References Cited

U.S. PATENT DOCUMENTS

2006/0077168 A1* 4/2006 Fujita ..... 345/100
2008/0225035 A1 9/2008 Hsu et al.
2008/0259062 A1* 10/2008 Lee ..... 345/204
2009/0002277 A1* 1/2009 Park et al. ..... 345/60

FOREIGN PATENT DOCUMENTS

CN 1645465 7/2005

* cited by examiner

*Primary Examiner* — Pegeman Karimi
(74) *Attorney, Agent, or Firm* — McClure, Qualey & Rodack, LLP

(57) ABSTRACT

A buffer generating an output signal and including a pull-high module and a pull-low module is disclosed. The pull-high module makes the output signal to have a rising edge. The pull-low module makes the output signal to have a falling edge. The falling edge includes a plurality of falling portions. A slope of a first falling portion of the falling portions is different from a slope of a second falling portion of the falling portions.

10 Claims, 5 Drawing Sheets

BUFFER AND DISPLAY SYSTEM UTILIZING THE SAME

CROSS REFERENCE TO RELATED APPLICATIONS

This Application claims priority of Taiwan Patent Application No. 99128790, filed on Aug. 27, 2010, the entirety of which is incorporated by reference herein.

BACKGROUND OF THE INVENTION

1. Field of the Invention

The invention relates to a buffer, and more particularly to a buffer generating an output signal comprising at least two falling slopes.

2. Description of the Related Art

FIG. 1A is a schematic diagram of a conventional display system. The display system 100 comprises a gate driver 110. The gate driver 110 provides a gate pulse GP to the pixel units $P_{121}$~$P_{12n}$ via the gate line 131. When the panel size of the display system 100 becomes larger, the length of the gate line 131 becomes longer. Thus, equivalent impedance of the gate line 131 is increased.

When the gate driver 110 provides the gate pulse GP to the pixel units $P_{121}$~$P_{12n}$ via the gate line 131, the signals of the pixel electrodes of some pixel units (e.g. $P_{121}$ and $P_{122}$) closed to the gate driver 110 are different from the signals of the pixel electrodes of some pixel units (e.g. $P_{12n}$ far away from the gate driver 110.

FIG. 1B is a schematic diagram of a relationship between the gate pulse GP and the signals of the pixel electrodes. The symbol $PE_{near}$ represents a signal of a pixel electrode of one pixel unit closed to the gate driver 110. The symbol $PE_{far}$ represents a signal of a pixel electrode of one pixel unit far away from the gate driver 110. As shown in FIG. 1B, the equivalent impedance of the gate line 131 causes level drift in the signals of the pixel electrodes. For example, the signal $PE_{near}$ comprises the voltage difference $\Delta V_1$, and the signal $PE_{far}$ comprises the voltage difference $\Delta V_2$. Since the voltage difference $\Delta V_1$ is different from the voltage difference $\Delta V_2$, the voltage differences $\Delta V_1$ and $\Delta V_2$ cannot be simultaneously compensated.

BRIEF SUMMARY OF THE INVENTION

In accordance with an embodiment, a buffer, which generates an output signal, comprises a pull-high module and a pull-low module. The pull-high module makes the output signal to have a rising edge. The pull-low module makes the output signal to have a falling edge. The falling edge comprises a plurality of falling portions. A slope of a first falling portion of the falling portions is different from a slope of a second falling portion of the falling portions.

In accordance with another embodiment, a display system comprises a gate driver, a source driver and a plurality of pixel units. The gate driver generates a plurality of scan signals and comprises a shift register, a level shifter and a buffer. The shift register generates a plurality of shifted signals. The level shifter transforms the level of each of the shifted signals to generate a plurality of transformation signals. The buffer increases driving ability of each of the transformation signals to generate a plurality of output signals. The output signals are served as the scan signals. The buffer comprises a pull-high module and a pull-low module. The pull-high module makes a first output signal of the output signals to have a rising edge, and the pull-low module makes the first output signal of the output signals to have a falling edge The falling edge comprises a plurality of falling portions. A slope of a first falling portion of the falling portions is different from a slope of a second falling portion of the falling portions. The source driver provides a plurality of data signals. The pixel units receive the data signals according to the scan signals and display a corresponding image according to the data signals.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
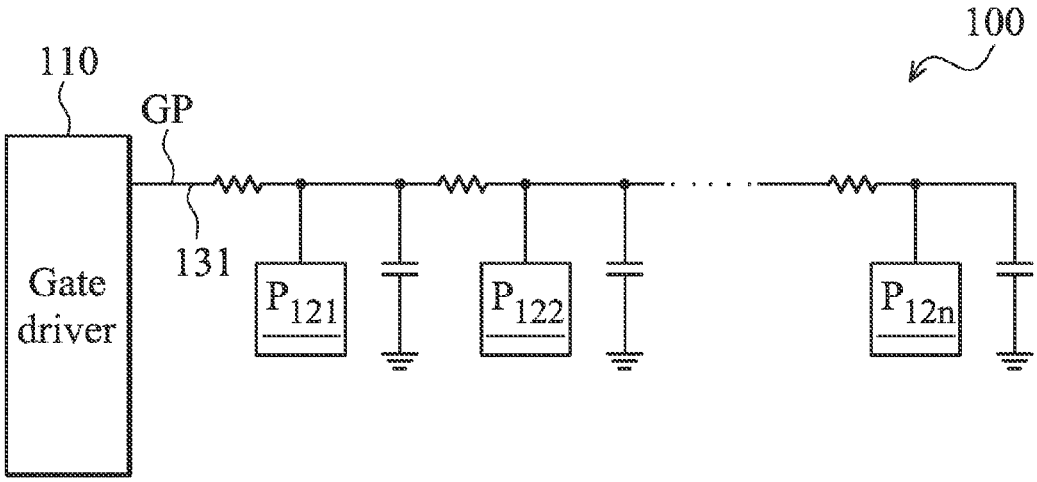
FIG. 1A ( PRIOR ART )
FIG. 1A is a schematic diagram of a conventional display system.
Figure 1B:
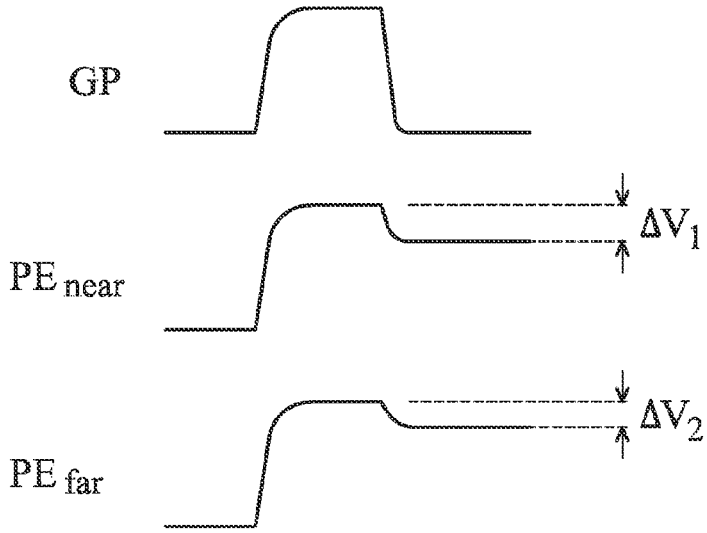
FIG. 1B ( PRIOR ART )
FIG. 1B is a schematic diagram of a relationship between the gate pulse GP and the signals of the pixel electrodes.
Figure 2:
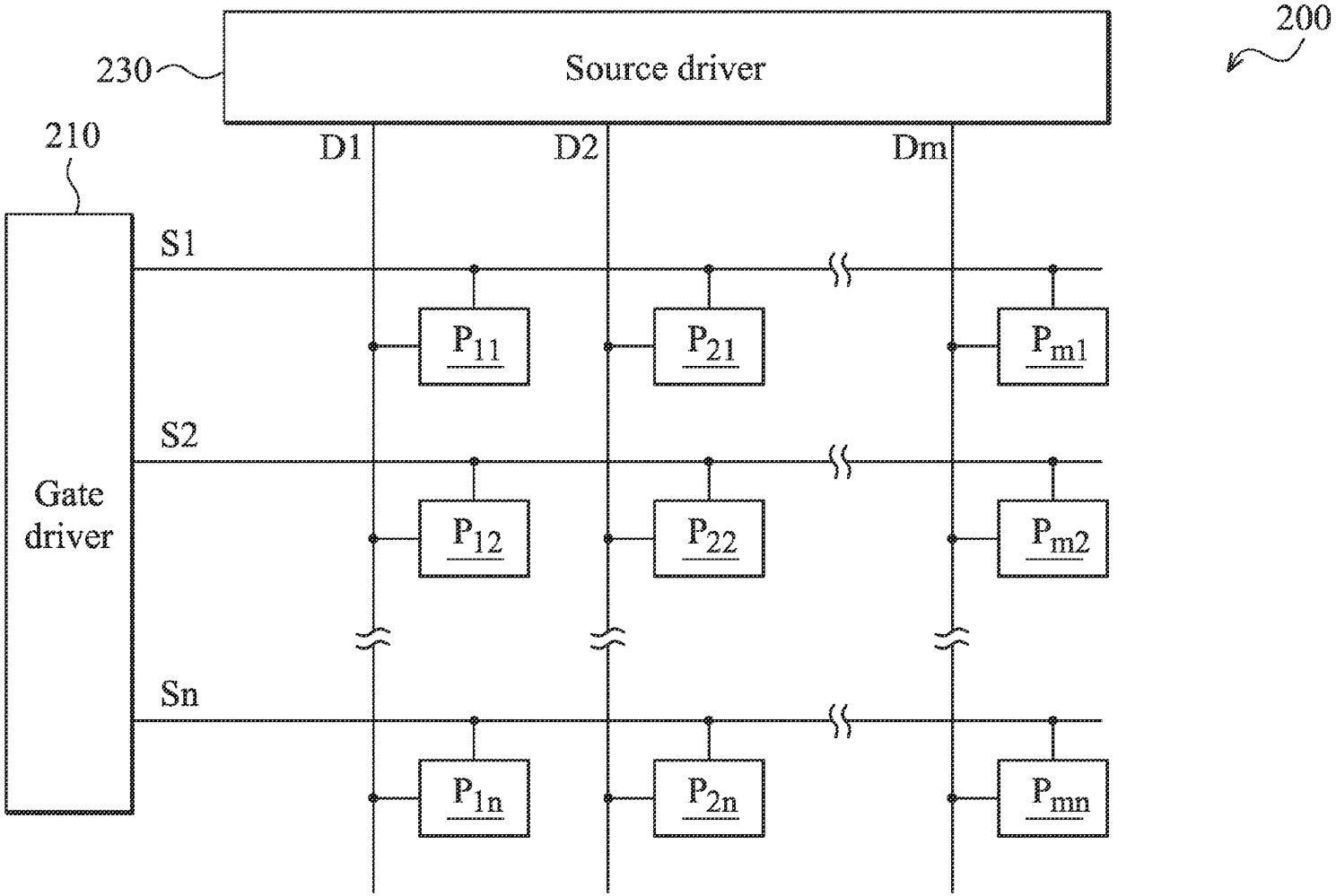
FIG. 2 is a schematic diagram of an exemplary embodiment of a display system of the invention.

FIG. 2 is a schematic diagram of an exemplary embodiment of a display system of the invention. The invention does not limit the kind of the display system 200. The display system 200 can be a personal digital assistant (PDA), a cellular phone, a digital camera, a television, a global positioning system (GPS), a car display, an avionics display, a digital photo frame, a notebook computer (NB) or a personal computer (PC). In this embodiment, the display system 200 comprises a gate driver 210, a source driver 230 and pixel units $P_{11}$~$P_{mn}$.

The gate driver 210 provides scan signals S1~Sn. The source driver 230 provides data signals D1~Dm. The pixel units $P_{11}$~$P_{mn}$ receive the data signals D1~Dm according to the scan signals S1~Sn and display a corresponding image according to the data signals D1~Dm.

Figure 3:
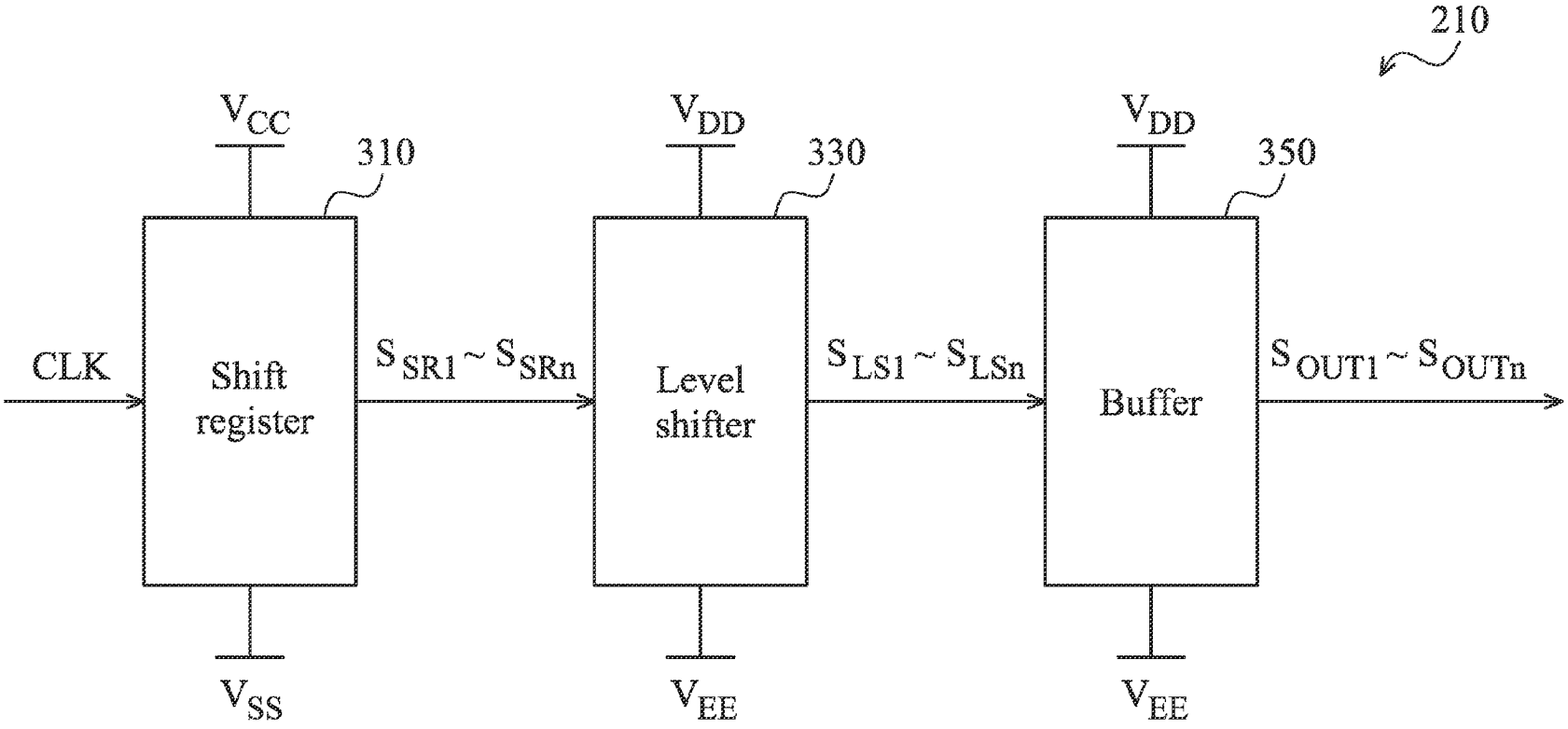
FIG. 3 is a schematic diagram of an exemplary embodiment of the gate driver of the invention.

FIG. 3 is a schematic diagram of an exemplary embodiment of the gate driver of the invention. The gate driver 210 comprises a shift register 310, a level shifter 330 and a buffer 350.

The shift register 310 generates shifted signals $S_{SR1}$~$S_{SRn}$ according to a start signal CLK. The level shifter 330 transforms the level of each of the shifted signals $S_{SR1}$~$S_{SRn}$ to generate transformation signals $S_{LS1}$~$S_{LSn}$. The buffer 350 increases the driving ability of each of the transformation signals $S_{LS1}$~$S_{LSn}$ to generate output signals $S_{OUT1}$~$S_{OUTn}$. In this embodiment, each of the output signals $S_{OUT1}$~$S_{OUTn}$ comprises a falling edge. The falling edge comprises at least two falling portions. The two falling portions comprise the different slopes.

The method of generating the shifted signals $S_{SR1}$~$S_{SRn}$ and the method of generating the transformation signals $S_{LS1}$~$S_{LSn}$ are well known to those skilled in the field, thus, the descriptions of the methods are omitted for brevity.

Additionally, in this embodiment, the output signals $S_{OUT1}$~$S_{OUTn}$ generated by the buffer 350 are served as the scan signals S1~Sn shown in FIG. 2. Each of the output signals $S_{OUT1}$~$S_{OUTn}$ comprises a falling edge. The falling edge comprises at least two falling portions. The two falling portions comprise the different slopes. If the output signals $S_{OUT1}$~$S_{OUTn}$ are served as the scan signals S1~Sn, signals of the pixel units closed to the gate driver are similar to signals of the pixel units far away from the gate driver. Thus, a feed-through effect can be avoided.

Figure 4A:
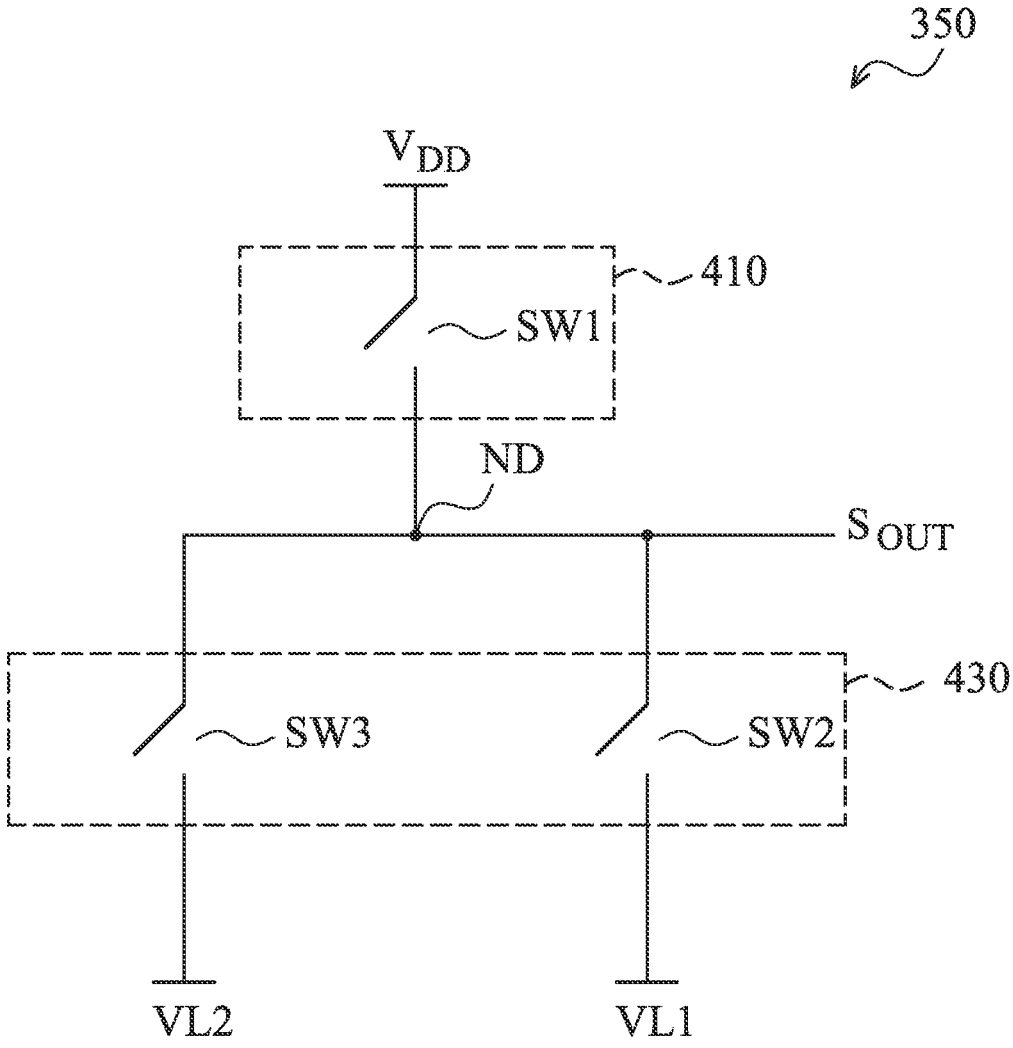
FIG. 4A is a schematic diagram of an exemplary embodiment of the buffer of the invention.

FIG. 4A is a schematic diagram of an exemplary embodiment of the buffer of the invention. To generate the output signals $S_{OUT1}$~$S_{OUTn}$, the buffer 350 comprises a multitude of buffer circuits. The buffer circuits are the same. Each buffer circuit generates a corresponding output signal. For clarity, FIG. 4A shows a buffer which only comprises one buffer circuit. The shown, the buffer circuit generates an output signal $S_{OUT}$. The output signal $S_{OUT}$ can serve as one of the output signals $S_{OUT1}$~$S_{OUTn}$.

As shown in FIG. 4A, the buffer 350 comprises a pull-high module 410 and a pull-low module 430. The pull-high module 410 makes the output signal $S_{OUT}$ to have a rising edge and the pull-low module makes the output signal $S_{OUT}$ to have a falling edge. In this embodiment, the falling edge of the output signal $S_{OUT}$ comprises various falling portions. A slope of a first falling portion of the falling portions is different from a slope of a second falling portion of the falling portions.

In other words, the falling edge of the output signal $S_{OUT}$ comprises the different slopes. In another embodiment, the falling edge of the output signal $S_{OUT}$ comprises three or more slopes. In this case, two slopes are the same, but different from the other slopes.

Figure 4B:
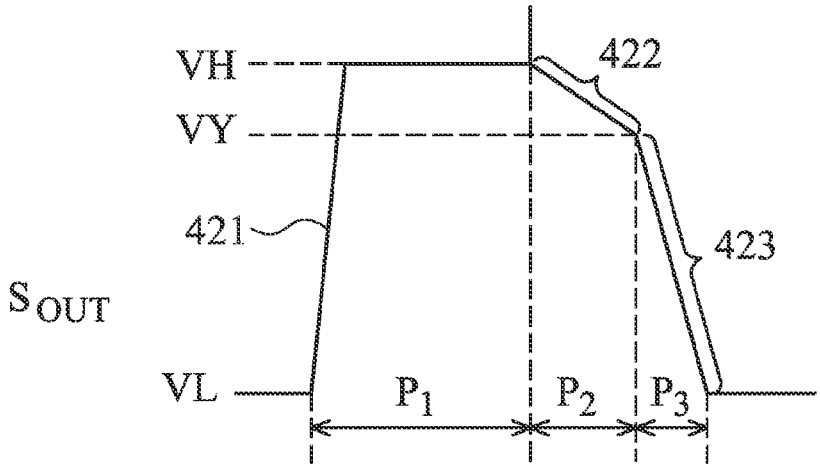
FIG. 4B is a schematic diagram of an exemplary embodiment of the output signal $S_{OUT}$.

FIG. 4B is a schematic diagram of an exemplary embodiment of the output signal $S_{OUT}$. During the period $P_1$, the pull-high module 410 pulls up the level of the output signal $S_{OUT}$ from the level VL to the level VH. Thus, the output signal $S_{OUT}$ comprises a rising edge 421. During the period $P_2$, the pull-low module 430 pulls down the level of the output signal $S_{OUT}$ from the level VH to the level VY. During the period $P_3$, the pull-low module 430 pulls down the level of the output signal $S_{OUT}$ from the level VY to the level VL. Thus, the output signal $S_{OUT}$ comprises a falling edge comprising falling portions 422 and 423. The slope of the falling portion 422 is different from the slope of the falling portion 423.

Figure 4C:
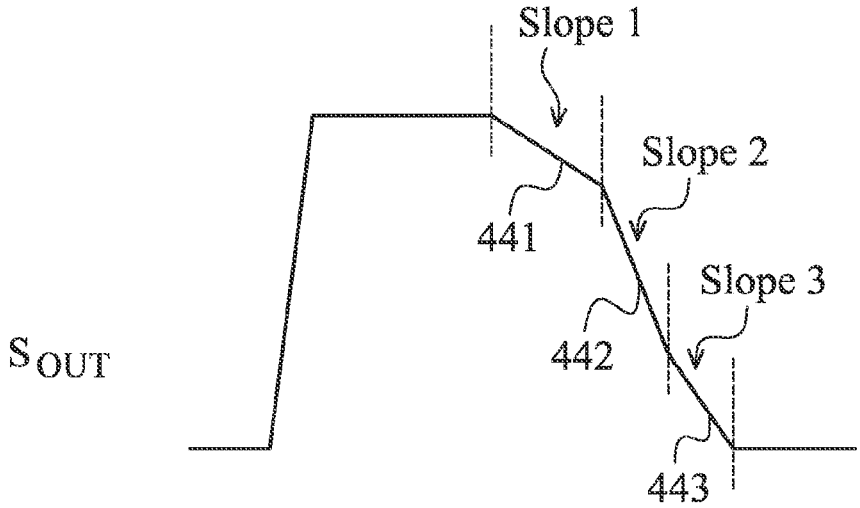
FIG. 4C is a schematic diagram of another exemplary embodiment of the output signal $S_{OUT}$.

FIG. 4C is a schematic diagram of another exemplary embodiment of the output signal $S_{OUT}$. In this embodiment, the falling edge of the output signal $S_{OUT}$ comprises falling portions 441~443 comprising slopes Slope1~Slope3. In FIG. 4C, the slopes Slope1~Slope3 are different, but the disclosure is not limited thereto. In other embodiments, the falling edge of the output signal $S_{OUT}$ comprises a first falling portion, a second falling portion and a third falling portion. The slope of the first falling portion is the same as the slope of the third falling portion. The slope of the third falling portion is different from the slope of the second falling portion.

Refer to FIG. 4A, wherein the pull-high module 410 comprises a switching unit SW1. The switching unit SW1 is coupled between the operation voltage $V_{DD}$ and a node ND. The node ND outputs the output signal $S_{OUT}$. During the period $P_1$, the switching unit SW1 is turned on to transmit the operation voltage $V_{DD}$ to the node ND. Thus, the output signal $S_{OUT}$ comprises a rising edge (e.g. the rising edge 421).

The pull-low module 430 comprises switching units SW2 and SW3. The switching unit SW2 is coupled between the node ND and the operation voltage VL1. During the period $P_2$, the switching unit SW2 is turned on, and the switching unit SW1 is turned off. Thus, the operation voltage VL1 is transmitted to the node ND. In this embodiment, the operation voltage VL1 is less than the operation voltage $V_{DD}$.

The switching unit SW3 is coupled between the node ND and the operation voltage VL2. During the period $P_3$, the switching unit SW3 is turned on to transmit the operation voltage VL2 to the node ND. The invention does not limit the relationship between the operation voltages VL1 and VL2.

In one embodiment, the operation voltage VL1 is less than the operation voltage $V_{DD}$ and is higher than the operation voltage VL2. In this case, when the switching units SW2 and SW3 are not simultaneously turned on, the switching unit SW2 is turned off during the period $P_3$.

In another embodiment, the operation voltage VL1 is equal to the operation voltage VL2, and is less than the operation voltage $V_{DD}$. In this case, the switching unit SW2 is turned on and the switching unit SW3 is turned off during the period $P_2$. During the period $P_3$, the switching units SW2 and SW3 are turned on.

The invention does not limit the structures of the switching units SW1~SW3. In one embodiment, the switching unit SW1 comprises at least one P-type transistor, and one of the switching units SW2 and SW3 comprises at least one N-type transistor. In another embodiment, the switching unit SW1 comprises at least one N-type transistor, and one of the switching units SW2 and SW3 comprises at least one P-type transistor.

Furthermore, the gate driver 210 comprises a minimum voltage served as the operation voltage VL2. For example, refer to FIG. 3, wherein the shift register 310 shifts the start signal CLK according to the operation voltages $V_{CC}$ and $V_{SS}$. In one embodiment, the operation voltage $V_{CC}$ is less than the operation voltage $V_{DD}$, and the operation voltage $V_{SS}$ is higher than the operation voltage $V_{EE}$. Additionally, the level shifter 330 transforms the levels of the shifted signals $S_{SR1}$~$S_{SRn}$ according to the operation voltages $V_{DD}$ and $V_{EE}$. In this embodiment, the operation voltage $V_{EE}$ is equal to the operation voltage VL2.

Since the output signal $S_{OUT}$ generated by the buffer 350 comprises at least two falling slopes, when the buffer 350 is applied in the gate driver of a display system, the output signal $S_{OUT}$ can solve the feed-through effect caused by parasitic capacitors (not shown). Thus, when the panel size of the display system is large, the pulse width of a scan signal provided to one row of the pixel units can be maintained.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A buffer generating an output signal, comprising:

a pull-high module making the output signal to have a rising edge and comprising:

a first switching unit coupled between a first operation voltage and a node, wherein the node is utilized to output the output signal, and during a first period, the first switching unit is turned on such that the first operation voltage is transmitted to the node making the output signal to have the rising edge; and a pull-low module making the output signal to have a falling edge, wherein the falling edge comprises a plurality of falling portions, and a slope of a first falling portion of the falling portions is different from a slope of a second falling portion of the falling portions, wherein the pull-low module comprises:

a second switching unit coupled between the node and a second operation voltage, wherein during a second period, the second switching unit is turned on such that the second operation voltage is transmitted to the node; and a third switching unit coupled between the node and a third operation voltage, wherein during a third period, the third switching unit is turned on such that the third operation voltage is transmitted to the node, wherein the second operation voltage is equal to the third operation voltage, and the second operation voltage is less than the first operation voltage.

2. The buffer as claimed in claim 1, wherein a slope of a third falling portion of the falling portions is different from the slope of the second falling portion of the falling portions, and the second falling portion is located between the first and the third falling portions.

3. The buffer as claimed in claim 1, wherein the second switching unit is turned on during the third period.

4. The buffer as claimed in claim 1, wherein the first switching unit comprises at least one P-type transistor, and one of the second and the third switching units comprises at least one N-type transistor.

5. A display system comprising:

a gate driver generating a plurality of scan signals and comprising:

a shift register generating a plurality of shifted signals;

a level shifter changing levels of the shifted signals to generate a plurality of transformation signals; and a buffer increasing driving ability of the transformation signals to generate a plurality of output signals, wherein the output signals are served as the scan signals, and the buffer comprises:

a pull-high module making a first output signal among the output signals to have a rising edge and comprising:

a first switching unit coupled between a first operation voltage and a node, wherein the node is utilized to output the output signal, and during a first period, the first switching unit is turned on such that the first operation voltage is transmitted to the node making the first output signal to have the rising edge;

a pull-low module making the first output signal to have a falling edge, wherein the falling edge comprises a plurality of falling portions, and a slope of a first falling portion of the falling portions is different from a slope of a second falling portion of the falling portions;

a source driver providing a plurality of data signals; and a plurality of pixel units receiving the data signals according to the scan signals and displaying a corresponding image according to the data signals, wherein the pull-low module comprises:

a second switching unit coupled between the node and a second operation voltage, wherein during a second period, the second switching unit is turned on such that the second operation voltage is transmitted to the node; and a third switching unit coupled between the node and a third operation voltage, wherein during a third period, the third switching unit is turned on such that the third operation voltage is transmitted to the node, wherein the second operation voltage is equal to the third operation voltage, and the second operation voltage is less than the first operation voltage.

6. The display system as claimed in claim 5, wherein a slope of a third falling portion of the falling portions is different from the slope of the second falling portion of the falling portions, and the second falling portion is located between the first and the third falling portions.

7. The display system as claimed in claim 5, wherein the second switching unit is turned on during the third period.

8. The display system as claimed in claim 5, wherein the first switching unit comprises at least one P-type transistor, and one of the second and the third switching units comprises at least one N-type transistor.

9. The display system as claimed in claim 5, wherein the level shifter transforms the levels of the shifted signals according to the first and the third operation voltages.

10. The display system as claimed in claim 9, wherein the level shifter transforms the levels of the shifted signals according to a fourth operation voltage and a fifth operation voltage, and the fourth operation voltage is less than the first operation voltage, and the fifth operation voltage is higher than the third operation voltage.

* * * * *